US005282410A

United States Patent [19]

Sanderson

[11] Patent Number: 5,282,410

[45] Date of Patent: Feb. 1, 1994

[54] EXTERNALLY MOUNTED AIRCRAFT AMMUNITION MAGAZINE BOX STRUCTURE

[76] Inventor: Paul H. Sanderson, 2019 Cripple Creek, Lewisville, Tex. 75067

[21] Appl. No.: 980,638

[22] Filed: Nov. 24, 1992

Related U.S. Application Data

[62] Division of Ser. No. 851,809, Mar. 16, 1992, Pat. No. 5,206,454.

[51] Int. Cl.[5] ..... F41A 23/00

[52] U.S. Cl. ..... 89/37.16; 89/37.22; 89/33.14

[58] Field of Search ..... 89/34, 33.1, 33.14, 89/33.16, 33.17, 37.16, 37.22, 37.19; 42/49.01, 50

[56] References Cited

U.S. PATENT DOCUMENTS

| | | | |
|---|---|---|---|
| 2,538,045 | 1/1951 | Ryan et al. | 89/37 |
| 3,086,425 | 4/1963 | Huey | 89/37.16 |
| 3,911,787 | 10/1975 | Seibel | 89/34 |
| 5,024,138 | 6/1991 | Sanderson et al. | 89/37.22 |

FOREIGN PATENT DOCUMENTS

| | | | |
|---|---|---|---|
| 2149069 | 6/1985 | United Kingdom | 89/37.16 |

OTHER PUBLICATIONS

General Electric, Vulcan Gun Systems, Jul. 1, 1971.

*Primary Examiner*—Stephen M. Johnson
*Attorney, Agent, or Firm*—Konneker, Bush & Hitt

[57] ABSTRACT

A high strength ammunition magazine box is externally mounted on the side of an aircraft by a support strut structure and is adapted to store a longitudinally serpentined ammunition belt which may be fed out to a machine gun also externally supported on the aircraft. The box has inboard and outboard side wall panels and a bottom wall panel, each of a honeycombed metal construction, with front and rear edges of the panels being epoxied into channels formed in solid metal front and rear end wall plates. A honeycombed metal lid panel is pivoted to the open upper end of the box and may be releasably held in a closed position by a spring-loaded latch bar. With the lid panel closed, a specially designed reinforcement structure securely interlocks the lid panel to upper portions of the inboard and outboard side wall panels so that relative front-to-rear movement therebetween is strongly resisted, in shear, by the lid panel. In one embodiment of the magazine box, recessed handles are provided on the exposed front and rear end wall plates to facilitate manual transport of the box. In another embodiment of the magazine box, a hollow fairing structure is pivotally secured to the front end plate and releasably latched over a specially designed front carrying handle accessible through an arcuate slot formed in the convexly curved front side of the fairing structure.

2 Claims, 6 Drawing Sheets

EXTERNALLY MOUNTED AIRCRAFT AMMUNITION MAGAZINE BOX STRUCTURE

This is a division of application Ser. No. 07/851,809, filed Mar. 16, 1992, now U.S. Pat. No. 5,206,454.

BACKGROUND OF THE INVENTION

The present invention relates generally to aircraft armament apparatus, and more particularly relates to ammunition magazine apparatus for aircraft-mounted machine guns.

Machine guns mounted on the exterior of an aircraft such as a helicopter, are typically supplied with ammunition by means of an elongated ammunition belt stored in a serpentined configuration within a magazine box and selectively drawn out of the box and fed to the gun. According to conventional practice, the magazine box is normally mounted inside the aircraft and the ammunition belt is routed outwardly through a suitable aircraft side wall opening to the externally mounted gun. However, the interior of the typical aircraft supplied with weaponry is often quite cramped already, and the location of ammunition magazines therein often renders it difficult to gain access to the magazines for loading and maintenance purposes.

In response to these access difficulties, another approach has been to mount the magazine within a specially designed shroud or pod which encloses the machine gun fed by the magazine. This approach is not entirely satisfactory either since an oversized, specially designed gun shroud must be used, and access to the magazine can still be somewhat tedious.

Another recently proposed solution has been to simply mount the magazine box on the outer side of the aircraft adjacent the machine gun fed by the magazine. While this approach provides for considerably easier access to the magazine box, it creates certain additional design problems which, until the present invention, have not been satisfactorily solved.

For example, there are three primary design criteria associated with an ammunition magazine box mounted externally on the side of an aircraft. First, the box must be as light as possible. Second, since the box will project outwardly from the side of the aircraft, thereby creating a source of additional drag on the aircraft during flight thereof, it should be at least relatively "smooth" from an aerodynamic standpoint. Third, the externally mounted magazine box must be highly crashworthy-i.e., be able to withstand very high accelerational or "G" loads without collapsing. Conventionally constructed magazine boxes externally mounted on the side of an aircraft have typically fallen somewhat short of meeting one or more of these primary design criteria.

Specifically, external magazine boxes of this type are usually formed from single layer metal walls, intersecured at their adjacent edges to form the overall box structure, and provided with a similarly constructed single layer metal lid. An inboard side wall of the magazine box is secured to the outer side of the aircraft to operatively mount the magazine box thereon. The single layer construction of this type of magazine box provides it with a suitably light weight but typically does not provide it with sufficient crashworthiness. To solve this problem it has heretofore been necessary to externally brace the box walls with rather sizeable outwardly projecting reinforcing ribs.

Such external bracing, while tending to alleviate the problem of high G-load collapse of the box, increases its weight to an undesirably high level while at the same time undesirably increasing the aerodynamic drag forces associated with the externally mounted magazine box.

In view of the foregoing, it can readily be seen that a need exists for an externally mountable ammunition box which is constructed to eliminate or minimize the above-mentioned and other problems, limitations and disadvantages heretofore associated with externally mounted ammunition magazine boxes of conventional construction. It is accordingly an object of the present invention to provide an externally mountable ammunition magazine box structure having a substantially improved construction.

SUMMARY OF THE INVENTION

In carrying out principles of the present invention, in accordance with preferred embodiments thereof, an improved ammunition magazine box is provided which may be externally mounted on the side of an aircraft, such as a helicopter, and is configured to internally store a longitudinally serpentined ammunition belt for outfeed to a machine gun also externally mounted on the aircraft.

The magazine box, in a first representative embodiment thereof, comprises horizontally spaced apart inboard and outboard side walls, a bottom wall, and a lid wall-each of a high strength, reinforced honeycomb metal construction with essentially planar opposite side surfaces. The front and rear end walls of the box are defined by solid metal end plates which have channels formed in their facing inner side surfaces. Front and rear edge portions of the side and bottom wall panels are received in these end plate channels, and are firmly anchored therein using a high strength epoxy material. The honeycombed lid panel is pivotally secured to the open upper end of the box, and latch means are provided for releasably holding the lid panel in a closed position.

An adjustable strut support structure is secured to the inboard side of the box and is used to attach the box to suitable external mounting brackets on the side of the aircraft. To facilitate manual transport of the magazine box, pivotally spring-loaded carrying handles are secured to the box end plates within outer side recesses formed therein.

The joining of adjacent front and rear edge portions of the honeycombed metal side and bottom wall panels of the box using the channeled solid metal end plates significantly improves the overall crashworthiness of the box while at the same time taking advantage of the desirably light weight of the honeycombed wall panels. Because of the very high strength of this unique interconnection of the honeycombed side and bottom wall panels, the previous need for external, outwardly projecting wall bracing structures is eliminated, thereby reducing the aerodynamic drag forces created by the box during flight of the aircraft upon which it is externally mounted.

The crashworthiness of the magazine box is also significantly increased, according to another feature of the present invention, by the provision of means for securely interlocking the honeycombed lid wall panel with upper edge portions of the inboard and outboard side wall panels of the box, when its lid is closed, in a manner such that front-to-rear relative movement between the inboard and outboard side walls is strongly resisted in shear by the honeycombed metal lid wall panel. In a preferred embodiment thereof, these interlocking means comprise a spaced plurality of notches formed in an outer frame portion of the box lid, and a spaced plurality of lugs carried by an upper portion of the outboard side wall panel and positioned to be received in the frame notches when the box lid is closed.

Due to the unique construction of the ammunition magazine box of the present invention, it has a reduced weight, improved crashworthiness, and less aerodynamic drag compared to conventionally fabricated ammunition magazine boxes externally mountable on the side of an aircraft.

In a second representative embodiment of the magazine box, a hollow, convexly curved fairing structure is hingedly secured to the front end plate for pivotal movement relative thereto, about a vertical axis adjacent the outboard side edge of the end plate, between a first position in which the fairing extends across and covers the front side of the plate, and a second position in which the front end plate is exposed. A convexly curved front carrying handle is anchored to the front side of the front end plate and has an arcuate front section complementarily received, when the fairing is in its first position, in an arcuate slot formed in the fairing. The arcuate front handle section has a hand insertion passage extending rearwardly therethrough and having a rear side that is normally closed by a spring-biased closure plate. Latch means are provided for releasably holding the fairing in its first position on the magazine box.

DETAILED DESCRIPTION

Figure 1:
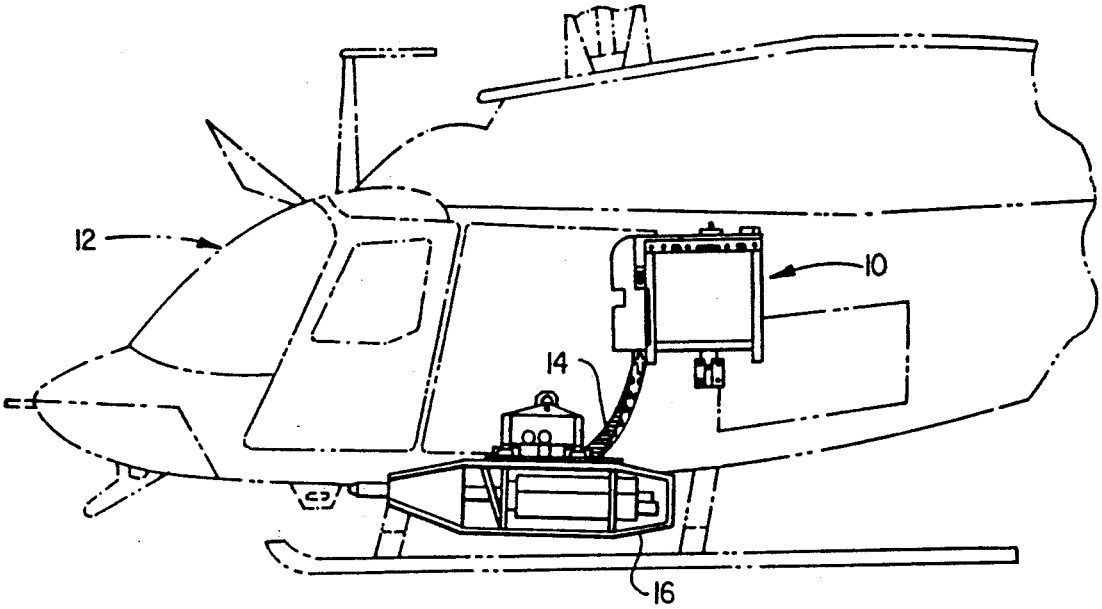
FIG. 1 is a phantomed side elevational view of a front portion of a representative helicopter to which a specially designed ammunition magazine box, embodying principles of the present invention, is externally secured and operative to feed belted ammunition to a machine gun also externally mounted on the helicopter.
Figure 2:
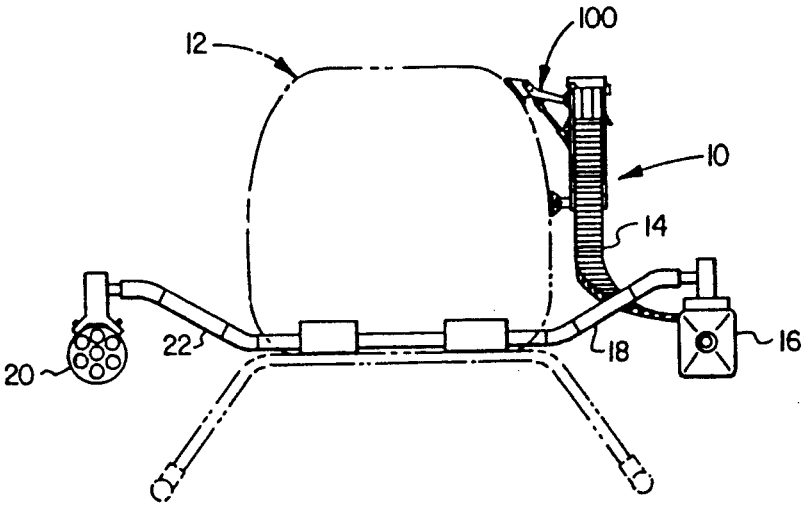
FIG. 2 is a simplified front end view of the helicopter.

Referring initially to FIGS. 1 and 2, the present invention provides a specially designed ammunition magazine box 10 which is externally secured, in a manner subsequently described, to one side of an aircraft such as the representatively depicted helicopter 12. The magazine box 10 is utilized to store, in a longitudinally serpentined orientation, an elongated ammunition belt 14, and to progressively feed the belt 14 to a machine gun 16 externally supported on the helicopter 12 at the outer end of a conventional support arm structure 18 projecting outwardly from the magazine side of the helicopter. The machine gun 16 is part of an overall helicopter armament system which also representatively includes a multiple tube rocket launcher 20 supported on the outer end of a support arm structure 22 projecting outwardly from the opposite side of the helicopter.

Figure 3:
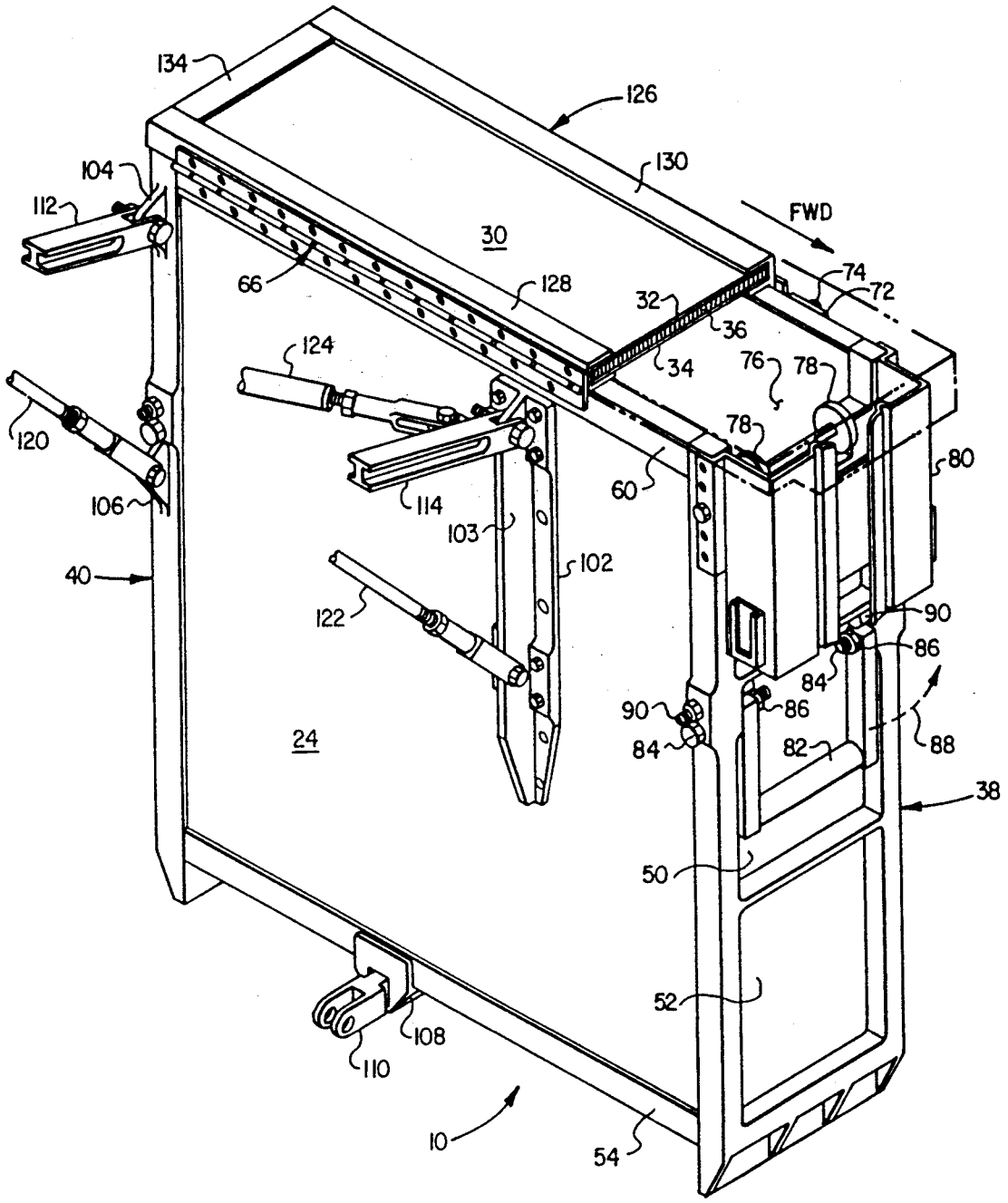
FIG. 3 is an enlarged scale, partially cut away inboard side perspective view of the magazine box.
Figure 7:
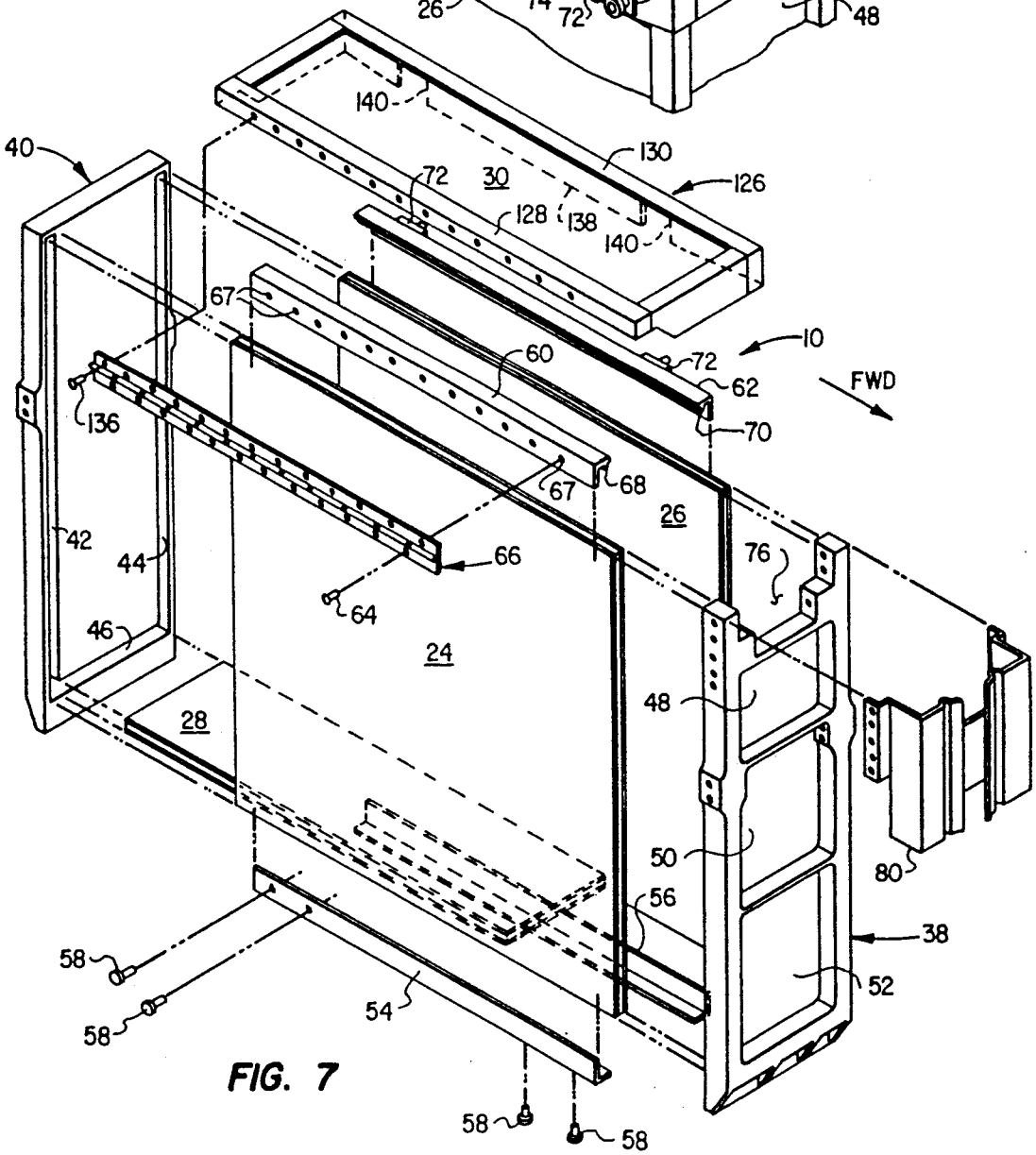
FIG. 7 is an enlarged scale exploded perspective view of the ammunition box, viewed from the inboard side thereof, with various of the feed and helicopter attachment components having been removed from the box for purposes of illustrative clarity.

Turning now to FIGS. 3 and 7, the magazine box 10 includes an inboard side panel 24 (which faces the right side of the helicopter 12 as viewed in FIG. 2), an outboard side panel 26, a bottom end panel 28, and a lid or top end panel 30. These four panels are each of a lightweight honeycombed construction which, as representatively illustrated for the panel 30 in FIG. 3, comprises relatively thin opposite metal side plates 32 and 34 between which is sandwiched a considerably thicker honeycombed metal filler structure 36. Each such side plate has a relatively smooth, essentially planar outer side surface. Due to this sandwiched honeycombed structure of each of the panels 24, 26, 28 and 30, each of the panels is light in weight yet has a very high degree of structural rigidity and strength. To further reduce the light weight which characterizes wall structures of this general configuration, the four wall panels of the magazine box 10 are preferably formed from aluminum.

Magazine box 10 also includes solid metal front and rear end plates 38 and 40 having various depressions formed therein by a suitable hogging-out process. As illustrated in FIG. 7, these depressions include vertical channels 42 and 44 formed in the interior side surfaces of each of the front and rear end plates 38 and 40, bottom end channels 46 formed on the interior side surfaces of the plates 38 and 40 and interconnecting the bottom ends of the vertical channels 42 and 44, and weight reducing depressions 48, 50 and 52 formed in the outer side of each of the front and rear end plates 38 and 40. In assembling the magazine box 10, front and rear vertical side edge portions of the panels 26 are inserted into the vertical end plate channels 42 and 44, front and rear end edge portions of the bottom end panel 28 are inserted into the bottom end channels 46, and the panel edge portion received in such channels are permanently bonded therein using a suitable aircraft grade ultra-high strength epoxy material.

Extending lengthwise between bottom end portions of the plates 38 and 40 are a pair of elongated bottom attachment brackets 54 and 56, having generally L-shaped cross sections, which outwardly overlie the adjacent edge portions of the bottom end panel 28 and the side panels 24 and 26 and are secured thereto by suitable fasteners 58 extending inwardly through the perpendicular leg portions of the brackets 54, 56 and into such edge portions of the panels 24, 26 and 28.

At the top edges of the side panels 24 and 26 are a pair of top attachment brackets 60 and 62 which have generally L-shaped cross sections. Brackets 60 and 62 longitudinally extend between the front and rear end plates 38 and 40 and respectively overlie the top edge portions of the side panels 24 and 26. The bracket 60 is secured to the inboard side wall panel 24 by fasteners 64 which are extended inwardly through the bottom leaf of an elongated piano hinge member 66, through openings 67 in the outer side leg of the bracket member 60, and into the side wall panel 24. The top side leg of the bracket member 60 has formed thereon a depending rib 68 which is received in a correspondingly configured slot (not shown) formed in the upper edge of the side wall panel 24.

Attachment bracket 62 is secured to the upper edge of the side wall panel 26 using fasteners similar to fasteners 64, and has, on its upper side leg, a depending rib 70 which is received in a correspondingly configured slot formed longitudinally along the upper edge of the side wall panel 26. Formed integrally with the bracket 62, and projecting laterally outwardly therefrom in an outboard direction, are a longitudinally spaced pair of rectangularly shaped lugs 72 from which a pair of cylindrical latch studs 74 outwardly extend.

With continued reference to FIGS. 3 and 7, the upper end of the front end plate 38 has formed therein a notched area 76 in which are journaled a pair of outlet guide wheels 78. The elongated ammunition belt 14 (FIGS. 1 and 2) is conventionally folded in a longitudinally serpentined fashion and stored within the interior of the magazine box 10. The outlet end of the belt is passed upwardly around the guide wheels 78 and then routed downwardly through an outlet bracket member 80, externally secured to an upper end of the front plate 38, for feed to the machine gun 16.

Figure 4:
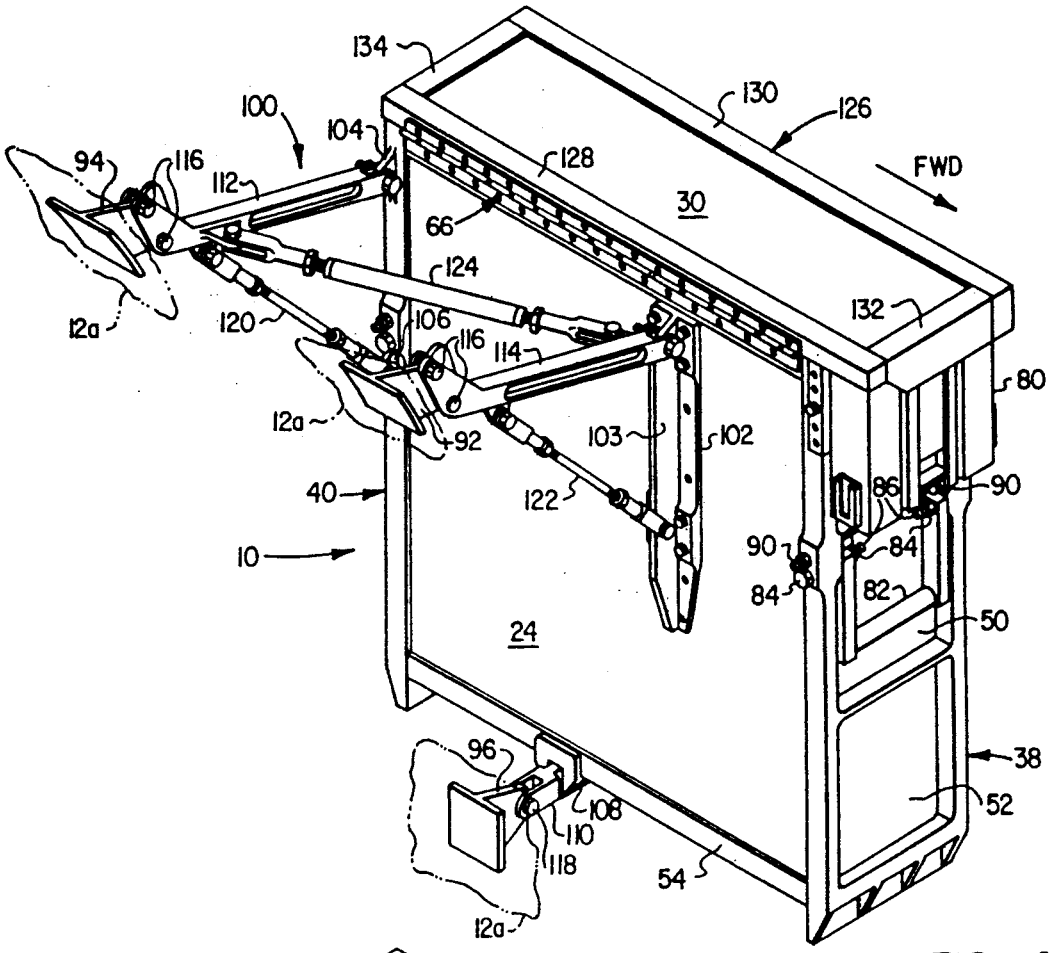
FIG. 4 is an enlarged scale inboard side elevational view of the ammunition box illustrating the manner in which it is externally secured to the side of the helicopter.

To facilitate the manual transport of the magazine box 10, a pair of U-shaped handle members 82 are pivotally secured within the outer side recesses 50 of the end plates 38 and 40 by pivot pins 84 projecting into such recesses, and pivotally biased toward their normal recessed position shown in FIGS. 3 and 4 by coil spring members 86 operatively interconnected between the handle members 82 and their associated pivot pins 84. Each of the handles 82 may be pivoted outwardly against the biasing force of its associated spring 86, as indicated by the arrow 88 in FIG. 3, to a carrying position in which the handle member projects transversely outwardly from its associated recess 50. A pair of stop pin members 90 extend inwardly to each of the recesses 50 and operate to engage the handle members 82 and limit their upward pivotal motion beyond their carrying positions. Upon release of the handles 82, the spring elements 86 automatically pivot the handles back to their normal positions within the end plate recesses 50.

With reference now to FIGS. 3 and 4, the magazine box 10 is operatively secured to two upper mounting flanges 92 and 94, and a lower mounting flange 96, which are suitably fastened to side portions of the helicopter 12, by means of an adjustable strut mounting system 100 which will now be described. The mounting system 100 includes a vertically oriented bracket 102 secured to the inboard side wall 24 and having a central rib 103, a vertically spaced pair of flanges 104 and 106 formed on the inboard side edge of the rear end plate 40, and a bracket 108 secured to the underside of the magazine box and having an attachment yoke portion 110 projecting outwardly therefrom. A pair of horizontally projecting elongated attachment members 112 and 114 are respectively pivoted at their inner ends to the flange 104 and an upper end portion of the central rib 103, and have yoked outer ends which are secured to the helicopter mounting flanges 92 and 94 by removable pin members 116. In a similar fashion, the lower attachment yoke 110 is secured to the lower helicopter mounting flange 96 by a pin member 118.

The attachment member 112 is vertically braced by means of a length-adjustable support rod structure 120 pivotally secured at its opposite ends to the flange 106 and an inboard end portion of the attachment member 112. In a similar fashion, the attachment member 114 is vertically braced by means of a length-adjustable support rod structure 122 pivotally secured at its opposite ends to the central rib 103 and an inboard end portion of the attachment member 114. The attachment members 112, 114 are horizontally braced by means of an elongated, length-adjustable support rod structure 124 pivotally connected at its opposite ends to an inboard end portion of the attachment member 112 and an outboard end portion of the attachment member 114. These support rod structures 120, 122 and 124, as illustrated in FIG. 4, have central portions which are threaded at their outer ends to the end portions of the particular support rod structure and may be rotated in a turnbuckle fashion to selectively lengthen or shorten the particular support rod structure. The overall mounting system 100 functions to rigidly secure the magazine box 10 to the helicopter, and the support rod structures 120, 122 and 124 may be appropriately lengthened as required to tighten the mounting system and eliminate any undesirable "play" therein.

Referring now to FIGS. 3–7, the magazine box 10 also includes a high strength lid structure 126 which includes the honeycombed metal lid panel 30 and further comprises a frame structure defined by suitably interconnected inboard and outboard frame side portions 128 and 130, and front end rear frame end portions 132 and 134. Each of these four lid frame portions has a generally U-shaped configuration and, as best illustrated in FIG. 3, receives an outer edge portion of the lid panel 30 so that the overall lid frame structure peripherally borders and captively retains the lid panel 30 therein.

The inboard frame side portion 128 is suitably secured to the upper leaf portion of the hinge 66, by means of fasteners 136, thereby permitting the lid structure 126 to be pivoted relative to the open upper end of the magazine box 10 between a closed position (illustrated in the drawings) in which the lid structure covers the upper end of the magazine box, and an open position in which the upper magazine box is uncovered.

Figure 6:
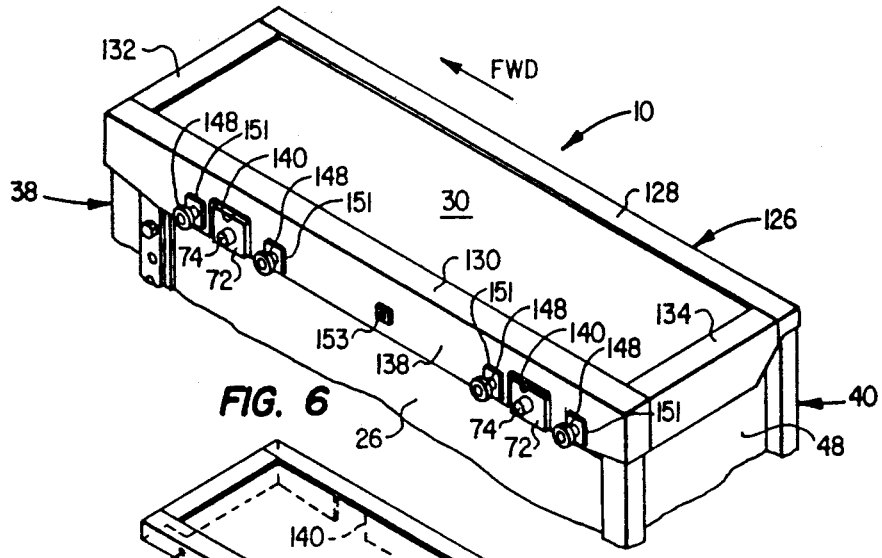
FIG. 6 is a view similar to that in FIG. 5, but at a somewhat smaller scale, and with a lid latch bar portion of the box removed for illustrative purposes.

As best illustrated in FIGS. 6 and 7, the outboard lid frame side portion 130 has a depending flange or skirt 138 in which a longitudinally spaced pair of rectangular notches 140 are formed. With the lid structure 126 pivoted downwardly to its closed position as depicted in FIG. 6, these skirt notches 140 closely receive the rectangular lugs 72 that, as previously described, project outwardly from the top attachment bracket 62 which is in turn fixedly secured to the top edge of the outboard side wall panel 26.

The lid structure 126 is releasably retained in its illustrated closed position by means of a latch structure which includes an elongated latch bar 142 (FIG. 5) having a pull rod 144 secured to and projecting outwardly from its left end. Latch bar 142 is captively retained on the frame skirt 138, for forward and rearward movement relative thereto as indicated by the double-ended arrow 146, by means of retaining pins 148 projecting outwardly through elongated slots 150, the pins 148 having enlarged outer ends which captively retain the latch bar 142 on the frame skirt 138 for movement therewith. As viewed in FIG. 5, the latch bar 142 is rightwardly biased toward its closed position by means of a coil spring member 152 received in an elongated latch bar slot 154 and operatively connected at its opposite ends to the frame skirt 138 and the latch bar 142.

Figure 5:
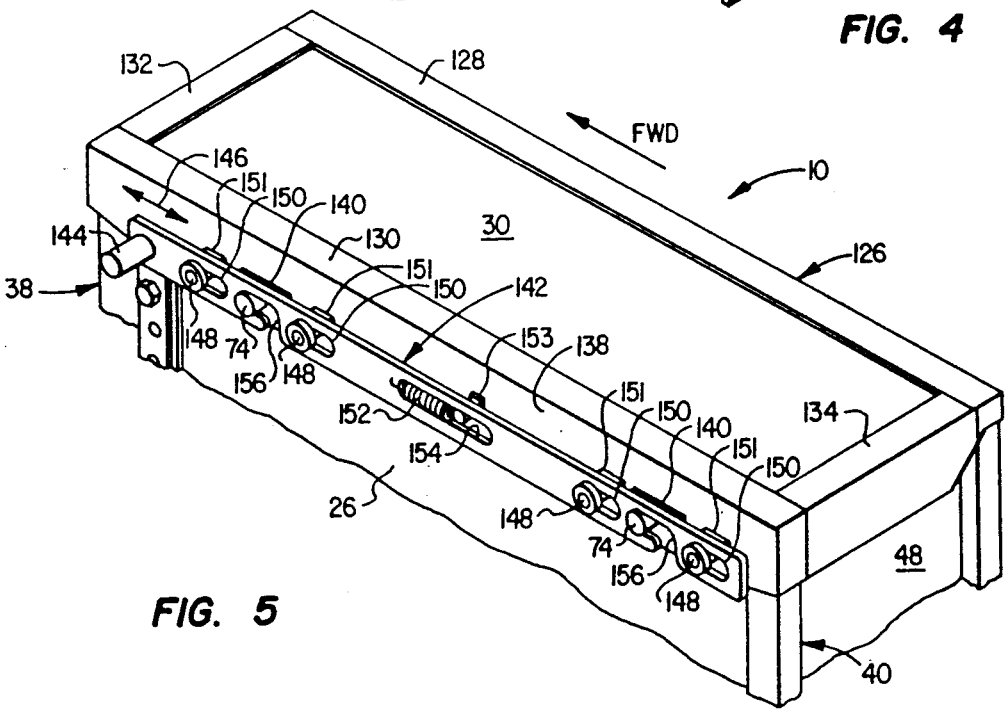
FIG. 5 is an enlarged scale outboard side elevational view of a top end portion of the magazine box.

Still referring to FIG. 5, the latch bar 142 has formed therein a pair of generally L-shaped slots 156 which extend inwardly from the lower side edge of the bar. To latch the lid structure 126 in its illustrated closed position, the rod 144 is pulled leftwardly, against the biasing force of the spring 152, to align the open bottom ends of the slots 156 with the previously described latch studs 74. The lid structure 126 is pivoted downwardly until the studs 74 enter the bottom ends of the slots 156. The pull rod 144 is then released so that the latch bar 142 is spring-driven back to its normally closed position in which the latch studs 74 are captively retained in the latch bar slots 156, as illustrated in FIG. 5, to prevent undesired opening of the lid structure 126. To re-open the lid, the pull rod 144 is moved leftwardly again to align the studs 74 with the open bottom ends of the latch bar slots 156, and the lid is pivoted in a clockwise direction as viewed in FIG. 5 to open the magazine box 10.

The magazine box 10 of the present invention provides a variety of structural advantages over conventionally fabricated external ammunition magazine boxes. For example, a very high degree of structural integrity and crashworthiness is achieved by the use of the honeycombed metal lid, bottom and opposite side panels of the box as described above. The crashworthiness of this panel assembly is augmented by the use of the solid metal end plates 38 and 40 whose inner side surface channels function to receive and join the honeycombed metal side and bottom panels in a manner which does not appreciably weaken the corner portions of this assembly as is normally the case when attempts are made to edge-connect two transverse honeycombed metal panels.

The use of the slotted end plates 38 and 40 to join the side and bottom panel portions of the magazine box 10 also very strongly resists any relative movement between these three panels, thereby greatly improving the overall crashworthiness of the box 10 without the need to externally brace the honeycombed panels. Such elimination of the necessity to externally brace the outer sides of the side and bottom wall panels advantageously reduces the overall weight of the magazine box. It also reduces the level of aerodynamic drag created by the box during flight of the aircraft to which it is attached.

The previously described interlock between the lugs 72 (FIG. 6) and the rectangular lid skirt notches 140 also significantly increases the overall crashworthiness of the magazine box 10. Specifically, with the lid structure 126 in its closed position, this interlock functions to directly connect, in a force transfer sense, the inboard side wall panel 24, the lid panel 30, and the outboard side panel 26. Accordingly, when a high forwardly or rearwardly directed acceleration force is imposed upon the outboard side panel 26, tending to move it forwardly or rearwardly relative to the inboard side panel 24, such relative front-to-rear movement between the opposite side wall panels is very strongly resisted in shear by the lid panel 30. As an example, a high forward force on the outboard side wall panel 26 is sequentially transferred to the lugs 72, the horizontally opposed vertical sides of the frame skirt notches 140, the lid panel 30, and to the inboard side panel 24 via the top attachment bracket 60. Accordingly, potential forward movement of the outboard wall panel relative to the inboard wall panel is strongly resisted in shear by the lid panel 30 along its entire front-to-rear length.

In addition to these strength, weight and aerodynamic advantages incorporated in the uniquely constructed magazine box 10, it will readily be appreciated by those skilled in this art that the magazine box 10 is of a comparatively simple design and is thus relatively easy to fabricate. The magazine box is quickly attachable to the exterior side of an aircraft such as the representative helicopter 12 and, due to its light weight and convenient handle means, may be quite easily hand-carried from place to place.

Illustrated in FIGS. 8–11 is an alternate embodiment **10*a* of the previously described magazine box 10. Except for the differences noted below, the box 10*a* has a construction similar to that of box 10. For ease in comparison, the components of the magazine box 10*a* similar to those in box 10** have been given identical reference numerals to which the subscript "a" has been added.

Figure 8:
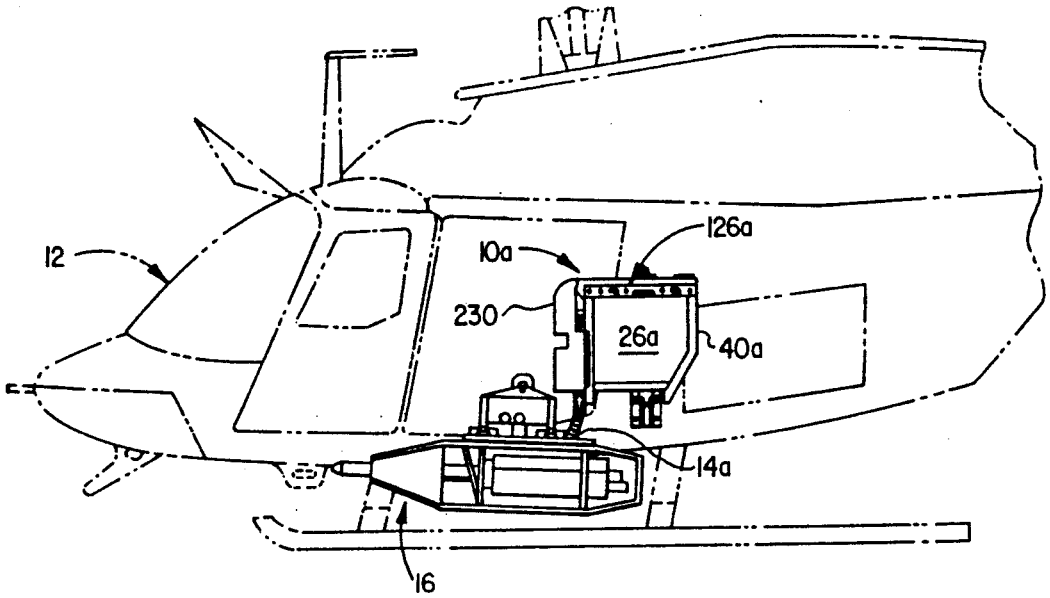
FIG. 8 is a phantomed side elevational view of a front portion of a representative helicopter to which an alternate embodiment of the ammunition magazine box is externally mounted.
Figure 9:
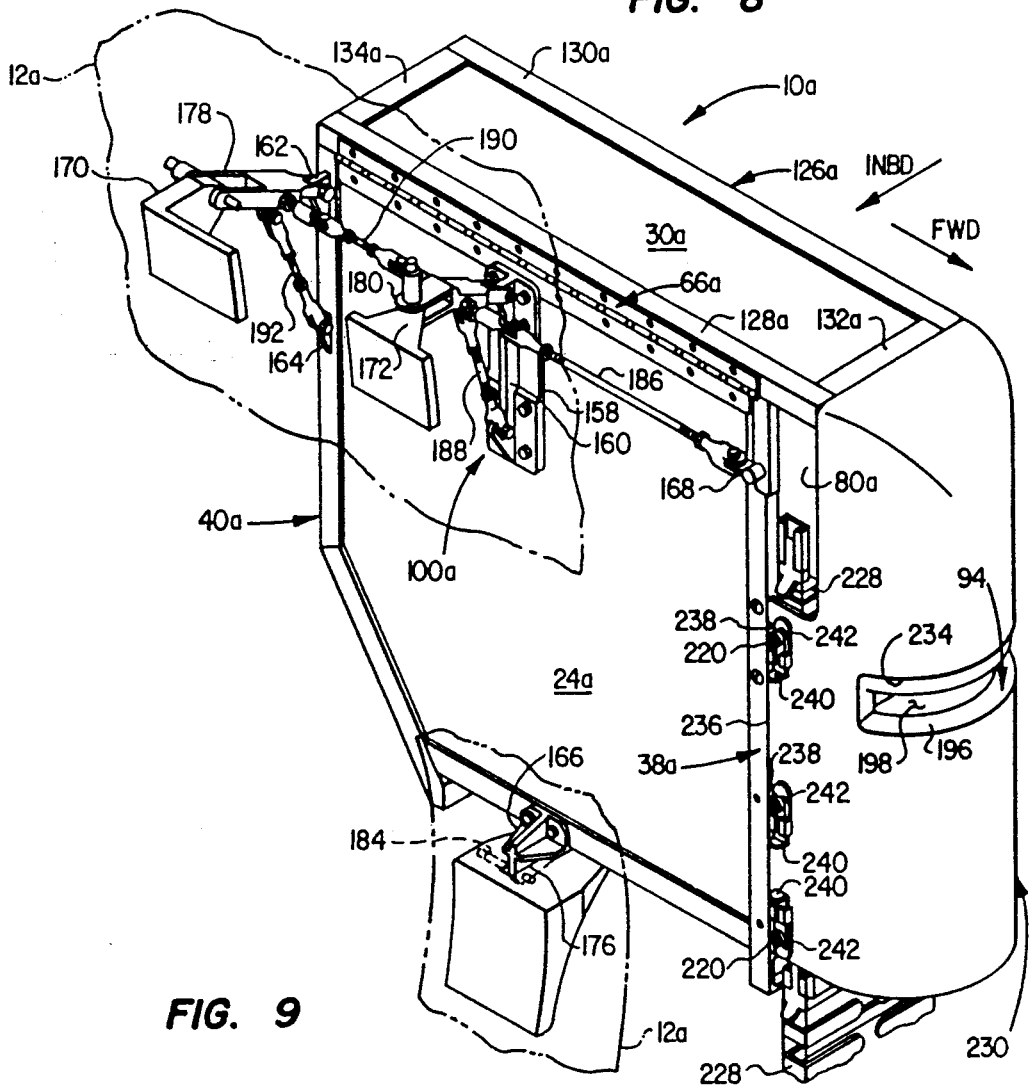
FIG. 9 is an enlarged scale inboard side perspective view of the FIG. 8 magazine box.

The magazine box **10*a*, as subsequently described, is configured to be mounted lower on the side wall of the helicopter 12, and thus closer to the machine gun 16, than the magazine box 10 as may be seen by comparing FIGS. 1 and 8. Like the previously described magazine box 10, the magazine box 10*a* has honeycombed metal side and bottom plates having front and rear edge portions received and epoxied within channels formed within solid metal front and rear end plates 38*a* and 40*a*. As best illustrated in FIG. 9, lower rear corner portions of the side panels are tapered (as shown on the visible side panel 24*a*), and a lower end portion of the rear end plate 40*a* correspondingly bent in a forward direction, to provide clearance space for a collapsible air transportability landing gear portion of the helicopter 12 (not illustrated) disposed beneath a rear portion of the magazine box 10*a***.

The lid structure **126*a* of the magazine box 10*a* is substantially identical to the previously described lid structure 126 of the magazine box 10 in both structure and operation, and the magazine box 10*a* is removably secured to exterior wall portions 12*a* of the helicopter 12 by means of an adjustable strut mounting system 100*a* having an upper bracket 158 secured to side panel 24*a* and having a central rib 160; a vertically spaced pair of brackets 162,164 mounted on the inboard side edge of rear end plate 40*a*; a bottom bracket 166 mounted on the inboard side of the bottom attachment member 54*a*; and a rearwardly projecting tab 168 mounted on the inboard side edge of front end plate 38*a***.

The mounting system **100*a* functions to connect the magazine box 10*a* to externally projecting lugs 170,172 on the helicopter 12 and a step portion 174 having a slot 176 extending downwardly therethrough. A yoke member 178 is pivotally interconnected between bracket 162 and lug 170, and a yoke member 180 is pivotally interconnected between the bracket rib 160 and the lug 172. A downwardly projecting rib 182 on the bottom bracket 166 is received within the step slot 176 and captively retained therein by a pin 184. The balance of the mounting system 100*a* comprises a length adjustable rod member 186 pivotally interconnected between the tab 168 and the yoke 180; a length adjustable rod member 188 pivotally interconnected between the bracket rib 160 and the yoke 180; a length adjustable rod member 190 pivotally interconnected between the yoke 180 and the yoke 178; and a length adjustable rod member 192 pivotally interconnected between the yoke 178 and the bracket 164. These length adjustable rod members are similar in construction and operation to those previously described in conjunction with the magazine box 10**.

Figure 10:
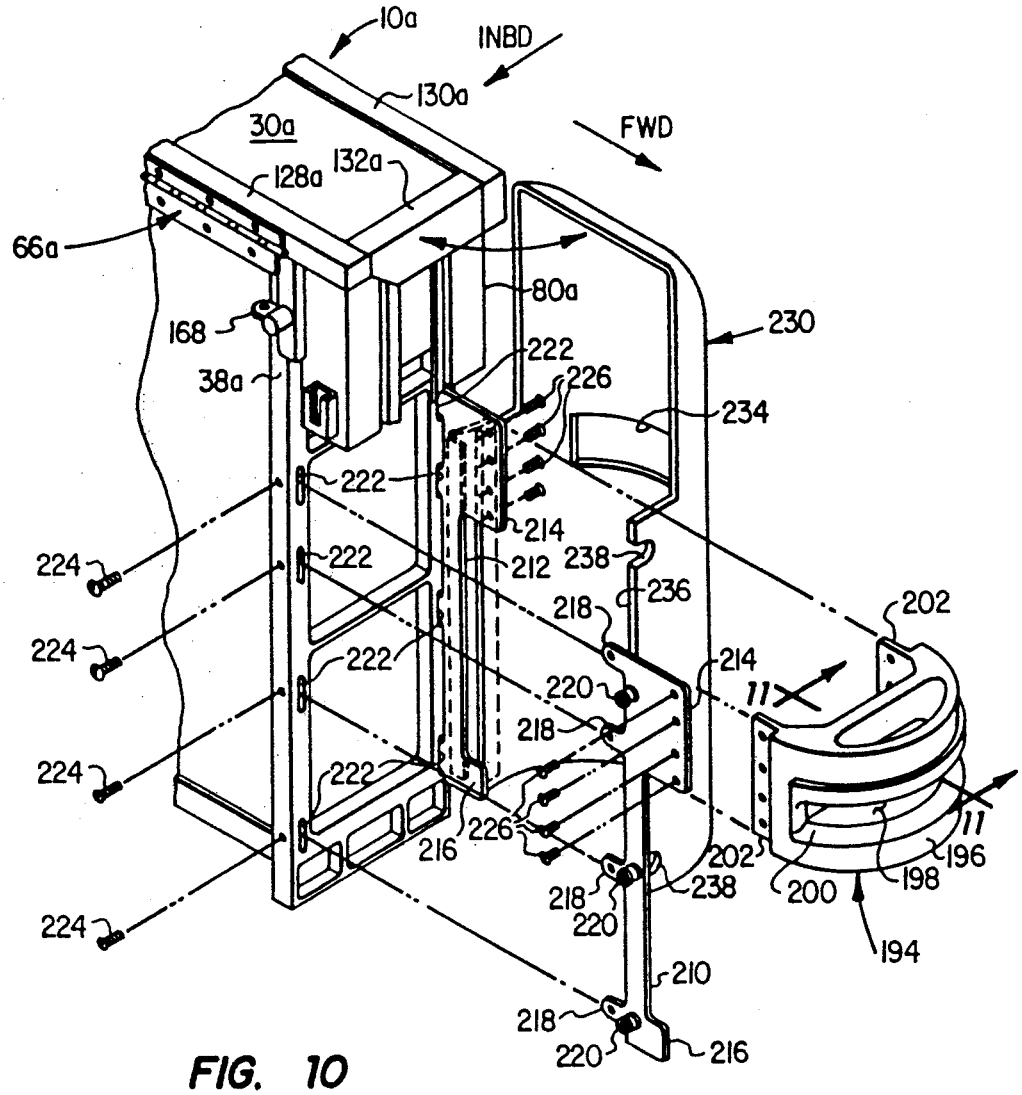
FIG. 10 is a partially exploded perspective view of a front end portion of the FIG. 8 magazine box.
Figure 11:
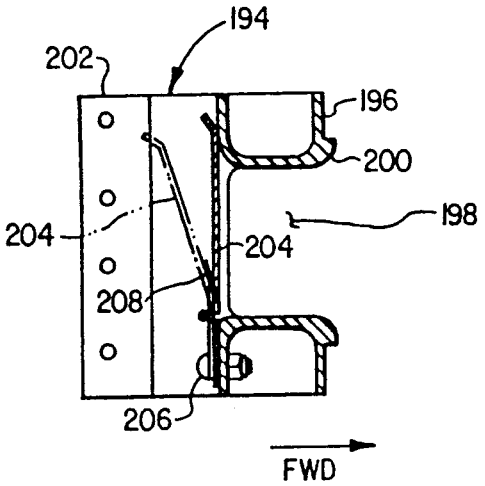
FIG. 11 is an enlarged scale cross-sectional view through a carrying handle portion of the FIG. 8 magazine box taken along line 11—11 of FIG. 10.

At the rear end of the magazine box 10*a* is a pivotally mounted external carrying handle (not visible) similar to the previously described handle 82 shown in FIG. 3. As best illustrated in FIGS. 10 and 11, a differently configured carrying handle 194 is provided at the front end of the magazine box 10*a*. Handle 194 has a generally U-shaped configuration with a convexly curved front face portion 196; an arcuate slot 198 extending rearwardly through face portion 196 and bordered by an outwardly projecting, curved rectangular portion 200; and a pair of rearwardly projecting connection tabs 202 on opposite sides of the handle.

The rear side of the handle slot 198 is normally covered by a closure plate 204 pivotally connected to the handle 194, at point 206, and biased toward its solid line closed position by a spring member 208. Handle 194 may be operatively gripped by slipping a hand rearwardly through the slot 198, thereby causing the plate 204 to be pivoted to its dotted line position (FIG. 11) while the handle is being gripped.

The front handle 194 is operatively mounted on the front end of the magazine box 10*a* using a pair of vertically elongated inboard and outboard mounting plates 210 and 212 each having an upper, forwardly projecting tab 214; a lower, forwardly projecting tab 216; and four vertically spaced, rearwardly projecting mounting tabs 218. For purposes later described, the inboard side of the mounting plate 210 is provided with three vertically spaced, outwardly projecting studs 220.

The rear tabs 218 of the mounting plates 210,212 are received in complementarily configured slots 222 formed in the front face of the front end plate 38*a*. Tabs 218 are held in place within their associated slots 222 by screws 224 extending through the inboard and outboard side edges of the front end plate 38*a*. The connection tabs 202 of the handle 194 are anchored to the upper front tabs 214 of the mounting plates 210,212 by screws 226 extending through the adjacent tab pairs 202,214 as shown in exploded form in FIG. 10.

Referring now to FIGS. 9 and 10, an outlet bracket 80*a*, through which the ammunition belt exits the magazine box, is anchored to a top front portion of the front end plate 38*a*. An ammunition feed chute 228 is operatively secured to the bottom end of outlet bracket 80*a* and extends downwardly along the front side of plate 38*a* past its bottom end. To improve the front end aerodynamics of the magazine box 10*a*, a high strength plastic fairing 230 is secured, by an elongated hinge structure 232, to an outboard side edge portion of the front end plate 38*a*.

As may be seen by comparing FIGS. 9 and 10, the fairing 230 is pivotable about a vertical axis between a closed position (FIG. 9) in which it covers the front side of the end plate 38*a*, and the handle 194, and an open position (FIG. 10) in which it exposes the front side of the plate 38*a*. With the fairing 230 in its closed position, the forwardly projecting curved handle portion 196 is complementarily received in an arcuate slot 234 formed in the convexly curved front side of the fairing.

A rear inboard side edge portion 236 of the fairing has three vertically spaced notches 238 formed therein, only two of which are visible in FIG. 10. With the fairing 230 pivoted to its closed position, the three studs 220 are received in these notches and project outwardly therefrom in an inboard direction. The fairing is releasably held in its FIG. 9 closed position by means of three small vertically movable latch members 240 externally supported on the fairing adjacent the notches 238. The latch members have open ends 242 which may be releasably snapped onto the studs 220 to hold the fairing in its closed position.

The foregoing detailed description is to be clearly understood as being given by way of illustration and example only, the spirit and scope of the present invention being limited solely by the appended claims.

What is claimed is:

1. An ammunition magazine structure for storing an elongated ammunition belt which may be selectively fed to a machine gun externally mounted on a side of an aircraft, said ammunition magazine structure comprising:

a magazine box for receiving and storing, in a serpentined orientation, the elongated ammunition belt, said magazine box having vertically positionable opposite inboard and outboard sides, a bottom side, front and rear sides, an upper end opening, a lid pivotally secured to the top of the box to selectively cover and uncover said upper end opening, and latch means for releasably holding said lid in a closed position; and attachment means for securing said magazine box to said side of the aircraft in a horizontally outwardly spaced relationship therewith, said attachment means including:

first and second elongated attachment members projecting generally transversely outwardly from said inboard side of said magazine box, said first and second elongated attachment members having inner ends secured to horizontally spaced portions of said inboard side of said magazine box, adjacent said upper end opening, said first and second elongated attachment members being pivotable relative to said magazine box about a horizontal axis extending in a front-to-rear direction and having outer ends, first and second elongated, length-adjustable bracing members each being connected at its opposite ends to said inboard side of said magazine box and one of said first and second attachment members, said first and second bracing members being sloped at a downward and outboard direction, a third elongated, length-adjustable bracing member connected at its opposite ends to longitudinally intermediate locations of said first and second attachment members, a third attachment member having a first end pivotally connected to a lower portion of said inboard side of said magazine box, and an outer end positioned outwardly of said magazine box, and means for securing the outer ends of said first, second and third attachment members to said side of the aircraft.

2. An ammunition magazine structure for storing an elongated ammunition belt which may be selectively fed to a machine gun externally mounted on a side of an aircraft, said ammunition magazine structure comprising:

a magazine box for receiving and storing, in a serpentined orientation, the elongated ammunition belt, said magazine box having vertically positionable opposite inboard and outboard sides, a bottom side, front and rear sides, an upper end opening, a lid pivotally secured to the top of the box to selectively cover and uncover said upper end opening, and latch means for releasably holding said lid in a closed position; and attachment means for securing said magazine box to said side of the aircraft in a horizontally outwardly spaced relationship therewith, said attachment means including:

first and second elongated attachment members projecting generally transversely outwardly from said inboard side of said magazine box, said first and second elongated attachment members having inner ends secured to horizontally spaced portions of said inboard side of said magazine box, adjacent said upper end opening, said first and second elongated attachment members being pivotable relative to said magazine box about a horizontal axis extending in a front-to-rear direction and having outer ends, a first, generally horizontally extending length-adjustable bracing member connected at its opposite ends to said first and second elongated attachment members, a second, generally horizontally extending length-adjustable bracing member connected at its opposite ends to said second elongated attachment member and a front portion of said magazine box, a third length-adjustable bracing member connected at its opposite ends to a longitudinally intermediate portion of said first elongated attachment member and to the inboard side of said magazine box beneath said first elongated attachment member, a fourth length-adjustable bracing member connected at its opposite ends to a longitudinally intermediate portion of said second elongated attachment member and to the inboard side of said magazine box beneath said second elongated attachment member, a third attachment member anchored to a lower inboard side portion of said magazine box and having an outer end, and means for securing the outer ends of said first, second and third attachment members to said side of the aircraft.

* * * * *